US005638842A

United States Patent [19]

Tokita et al.

[11] Patent Number: 5,638,842

[45] Date of Patent: Jun. 17, 1997

[54] DEVICE FOR REMOVING A FILM-LIKE IMAGE FORMING SUBSTANCE FROM A RECORDING MEDIUM

[75] Inventors: Toshiaki Tokita, Zama; Akiko Konishi, Tokyo; Yasuo Miyoshi, Yokohama; Kakuji Murakami, Kamakura; Kiyoshi Tanikawa, Yokohama, all of Japan

[73] Assignee: Ricoh Company, Ltd., Tokyo, Japan

[21] Appl. No.: 433,019

[22] Filed: May 3, 1995

[30] Foreign Application Priority Data

May 9, 1994 [JP] Japan ..... 6-119528

[51] Int. Cl.[6] ..... B08B 3/04

[52] U.S. Cl. ..... 134/104.1; 134/201; 118/203; 15/256.51; 15/256.52

[58] Field of Search ..... 118/652, 261, 118/262, 203; 355/299; 15/256.51, 256.52; 68/202; 134/22.19, 38, 104.1, 201

[56] References Cited

U.S. PATENT DOCUMENTS

| | | | |
|---|---|---|---|
| 936,842 | 10/1909 | Wilson | 134/38 |
| 1,700,518 | 1/1929 | Schultz | 101/425 |
| 3,913,797 | 10/1975 | Brym | 101/425 |
| 4,019,217 | 4/1977 | Schinke | 118/203 |
| 4,196,018 | 4/1980 | Inoko et al. | 134/38 |
| 4,393,778 | 7/1983 | Kaneko | 101/425 |
| 4,548,611 | 10/1985 | Paterson et al. | 68/202 |
| 4,624,023 | 11/1986 | Fleissner | 68/202 |
| 4,872,416 | 10/1989 | Daniel et al. | 118/203 |
| 4,894,095 | 1/1990 | Schramm et al. | 134/38 |
| 5,031,000 | 7/1991 | Pozniakas et al. | 118/652 |
| 5,220,868 | 6/1993 | Dunnam | 101/425 |
| 5,390,598 | 2/1995 | Stauffer | 101/425 |
| 5,485,662 | 1/1996 | Hodges, Jr. et al. . | |

*Primary Examiner*—Frankie L. Stinson

*Attorney, Agent, or Firm*—Oblon, Spivak, McClelland, Maier & Neustadt, P.C.

[57] ABSTRACT

A device for removing a film-like image forming substance from a recording medium for thereby regenerating the medium. A supply section supplies to the medium a water-containing removal accelerating liquid which causes a swelling layer of the medium to swell more than the substance provided on the medium. A separating section presses, after the liquid has been supplied to the medium, a separating member against the medium with or without heating to thereby transfer the substance from the medium to the separating member and thereby regenerates the medium. A cleaning section removes impurities deposited on the separating member.

11 Claims, 5 Drawing Sheets

DEVICE FOR REMOVING A FILM-LIKE IMAGE FORMING SUBSTANCE FROM A RECORDING MEDIUM

BACKGROUND OF THE INVENTION

The present invention relates to a device for removing a film-like image forming substance from a recording medium for thereby regenerating the medium.

Recent office automation has brought about the consumption of a great amount of printer sheets and copier sheets and, therefore, a great amount of waste sheets in offices. Most of the waste sheets are simply disposed of. The disposal of the waste sheets not only needs an extra cost, but also deteriorates the local environment due to the processing of the sheets. Moreover, it deteriorates the environment in the global scale due to excessive lumbering.

It has been customary to recycle the sheets by removing ink therefrom, immersing them in a liquid, and then making new sheets. Today, an advanced kind of sheets are under development which can be recycled for copying and printing purposes if text images formed thereon are removed by cleaning. For example, Japanese Patent Laid-Open Publication 4-670043 discloses a sheet having a substrate whose surfaces, particularly one surface, is treated to have a parting ability. The substrate with the parting ability is provided with a mark to be distinguished from ordinary sheets. However, this kind of sheet is special and not feasible for a copier because an image cannot be stably fixed thereon. Japanese Patent Laid-Open publication Nos. 1-101576 and 1-101577 each teaches a method of removing an image from a sheet by treating the sheet with ultrasonic waves in an organic solvent, which dissolves a film-like image forming substance (toner) on the substrate of the sheet. The organic solvent, however, brings about environmental pollution as well as hazards due to its inflammability and toxicity. Hence, this kind of scheme is not feasible for offices and homes. Japanese Patent Laid-Open publication No. 1-297294 proposes a cleaning method practicable with a substrate made of plastic, metal, paper low in infiltration, ceramic or similar material. The method heats, with the intermediary of a thermally soluble separating body, an image formed on such a kind of substrate. However, this approach is not practicable without resorting to a special sheet whose surfaces are provided with a parting ability.

On the other hand, Japanese Patent Laid-Open Publication No. 4-255916 teaches a method and device for removing a film-like image forming substance from a recording medium having a layer which swells when brought into contact with a liquid. The swelling layer is formed at least on the side of the medium where an image is to be formed. The device includes supplying means for supplying to the medium a water-containing liquid (removal accelerating liquid) which causes the swelling layer to swell more than the substance provided on the medium. Separating means presses, after the liquid has been supplied to the medium, a separating member against the medium with or without heating to thereby transfer the substance from the medium to the separating member. It was experimentally determined that this method is capable of removing only the film-like image forming substance from the medium without damaging the texture of the medium to a noticeable degree, thereby restoring the medium to a reusable condition. It should be noted that the word "film-like" refers not only to a condition wherein the entire image forms a single film, but also to a condition wherein the substance is not infiltrated deep into the medium, and a condition wherein the substance is not adsorbed by the medium almost at the molecule level. This kind of adsorption occurs with water ink containing a dye.

SUMMARY OF THE INVENTION

It is an object of the present invention to provide a device for removing a film-like image forming substance from a recording medium, and capable of separating the substance stably and repeatedly.

A device for removing a film-like image forming substance from a recording medium of the present invention has a supply section for supplying to the medium a water-containing removal accelerating liquid which causes a swelling layer of the medium to swell more than the substance provided on the medium. A separating section presses, after the liquid has been supplied to the medium, a separating member against the medium with or without heating to thereby transfer the substance from the medium to the separating member and thereby regenerates the medium. A cleaning section removes impurities deposited on the separating member.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
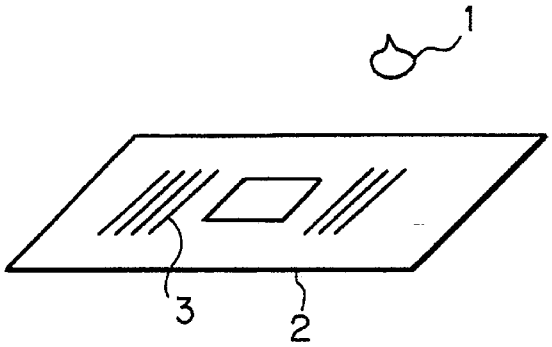
FIG. 1 is a perspective view showing a liquid supply section included in a device of the present invention.

We repeated the removal of a film-like image forming substance from a recording medium by use of a separating member, and found that a residual image appeared on the medium as the removal was repeated. This is because the substance is left on the medium without being fully removed by the separating member. Specifically, as the removal is repeated, the amount of impurities deposited on the surface of the separating member increases and lowers the ability of the separating member, resulting in the residual image. The impurities include the image forming substance, paper dust and smears transferred from the medium to the separating member, and part of the material constituting the separating member and come off the member.

The device of the present invention is characterized in that cleaning means is provided for cleaning the surface of the separating member, as will be described with reference to the accompanying drawings.

As shown in the figures, an image is formed on the surface of a recording medium 2 by a film-like image forming substance 3. The medium 2 may be a printer sheet or a copier sheet by way of example. A removal accelerating liquid 1 is infiltrated into the medium 2 in order to reduce the adhesion between the substance 3 and the surface of the medium 2.

The removal accelerating liquid, or accelerator as referred to hereinafter, 1 may be implemented by an aqueous solution containing a surfactant and/or a water-soluble high molecule. Further, there may be added to the aqueous solution a pH control agent, chelate agent for sealing heavy metal ions, antifungal agent, rust inhibitor, and bleach, if desired.

When the accelerator 1 is an aqueous solution containing a surfactant, the surfactant should preferably lie in a range of from 0.01 wt % to 20 wt %, more preferably from 0.1 wt % to 5 wt %. It is preferable that the surfactant be stably dispersible or soluble to water. A surfactant having this characteristic may be selected from a group of anion surfactants including soap, N-acyl amino acid, alkylether acetate, acylated peptide and other carboxylates, alkyl sulfonate, alkyl benzene sulfonate,alkyl naphthalene sulfonate, sulfosuccinate, α-olefin sulfonate, N-acyl sulfonate and other sulfonates, sulfated oil, alkyl sulfate, alkylether sulfate, alkylamide sulfate and other sulfuric esters, and alkyl phosphate, alkylether phosphase, alkylaryl phosphate and other phosphoric esters. Cation surfactants include aliphatic amin, alkyl quaternary ammonium salt, aromatic quaternary ammonium salt, and heterocyclic quaternary ammonium salt. Ampholytic surfactants include carboxy betaine, sulfobetaine and other betaines, amino carboxylate, and imidazoline derivative.

Noionic surfactants include polyoxyethylene alkylether, polyoxyethylene arylether, polyoxyethylene styrolether, polyoxyethylene lanolin derivative, ethylene oxide derivative of alkylaryl formaldehyde condensation product, polyoxyethylene polyoxypropylene block copolymer, polyoxyethylene plyoxypropylene alkylether and other ethers, polyoxyethylene glycerin fatty acid ester, polyoxyethylene sorbitan fatty acid ester, polyoxyethylene sorbitol fatty acid ester and other ether-ester compounds, polyethylene glycol fatty acid ester, fatty acid monoglycelid, polyglycerin fatty acid ester, sorbitan fatty acid ester, propylene glycol fatty acid ester, sucrose fatty acid ester and other esters, alphatic alkanol amide, polyoxyethylene fatty acid amide, polyoxyethylene alkylamine, alkylamine oxide and other nitrogen-containing compounds.

Fluorine-based surfactants include fluoroalkyl carboxylate, fluoroalkyl sulfonate and other anion compounds, fluoroalkyl-introduced betain and other ampholytic compounds, nonion compounds, and cation compounds.

Further, use may be made of a silicone-based surfactant, if desired.

The surfactants mentioned above may be used alone or in combination. A water-soluble high molecule may be added to the accelerator 1 alone or together with the surfactant in order to improve the removing ability or to improve the regenerated state. The water-soluble high molecule may be selected from a group of natural high molecules, a group of semisynthetic high molecules, or a group of purely synthetic high molecules. The natural high molecules include acacia, tragacanth gum, karaya gum, locust bean gum, arabino galactone, pictin and other vegetable high molecules, alginic acid, agar, funori and other seaweed high molecules, gelatin, casein, albumin, collagen and other animal high molecules, and xanthene gum, dextran and other microbial high molecules. The semisynthetic high molecules include methyl cellulose, ethyl cellulose, hydroxyethyl cellulose, carboxymethyl cellulose and other fibrous high molecules, soluble starch, carboxymethyl starch (CMS), dialdehyde starch, starch sodium glycolate, starch sodium phospholic ester and other starch-based high molecules, sodium alginate, propylene glycone algynic ester and other seaweed high molecules. The purely synthetic high molecules include polyvinyl alcohol, polyvinyl pyrrolidone, polyvinyl methylether and other vinyl-based high molecules, nonbridged polyacrylamide, polyacryl acid and other alkaline metal salts, water-soluble styrerie acryl resin, water-soluble styrene maleinic acid resin, water-soluble vinylnaphthalene acryl resin, water-soluble vinylnaphthalene maleinic acid resin, polyvinyl pyrrolidone, polyvinyl alcohol, alkaline metal salt of β-naphthalene formalin sulfonate condensation product, high molecules having a quaternary ammonium, amino group or similar cationic functional group in the side chain, and shellac and other natural high polecular compounds.

The water-soluble high molecule mentioned above should preferably be added in an amount of 1 wt % to 20 wt %, more preferably 0.1 wt % to 10 wt %, although dependent on the method of supplying the accelerator 1.

In accordance with the present invention, the medium 2 is caused to hold the water-soluble high molecule while containing water with or without the surfactant. This implements a body for removing the image forming substance 3 from the medium 2. The water-soluble high molecule can contact the image in the cellulose fibers, which cannot contact the separating body, in a cellulose fibers/image/high molecule/separating body configuration. As a result, the high molecule is capable of removing the image due to its adhesion without damaging the texture of the medium 2.

The pH control agent, which may also be added to the accelerator 1, should only be capable of controlling the pH value to 7 or above without affecting the accelerator 1. This kind of agent may be diethanolamine, triethanolamine or similar amin, lithium hydroxide, sodium hydroxide, potassium hydroxide or similar hydroxide of alkaline metal, ammonium hydroxide, hydroxide of quaternary ammonium, hydroxyde of quaternary sulfonium, lithium carbonate, sodium carbonate, potassium carbonate or similar carbonate of alkaline metal.

The chelate reagent, which may also be added to the accelerator 1 for promoting the separation, may be implemented by ethylenediamine tetraacetosodium, nitrilotriacetosodium, hydroxyethyl ethylenediamine triacetosodium, diethylenetriamine pentaacetosodium, or uramil diacetosodium of example. The rust inhibitor may be acid sulfate, sodium thiosulfate, ammon thioglycolate, diisopropylammonium nitrite, pentaerythritol tetranitrate, or dicyclohexylammounium nitrite. The antifungal and antiseptic agent may be sodium dehydroacetate, sodium sorbinate, 2-pyridinethiol-1-oxide sodium, soium benzoate, or pentachlorophenol sodium.

The bleach, which may also be added to enhance the whiteness of the regenerated medium 2, may be hydrogen peroxide, sodium peroxide, sodium percarbonate, or sodium hypochlorite. A fluorescent dye, bluing, enzyme or the like may be added, if desired. The contact angle of the accelerator 1 with the image forming substance should preferably be less than 90 degrees, more preferably less than 50 degrees. The surface tension of the accelerator 1 should preferably be less than 70 mN/m (dyne/cm), more preferably less than 50 mN/m. Assuming that the duration of contact of the water-containing liquid 1 and the medium 2 is t, then it is preferable that the accelerator 1 infiltrates into the medium 1 at a rate of higher than 10 ml/m$^2$, more preferably higher than 12 ml/m$^2$, for the time t.

Figure 2:
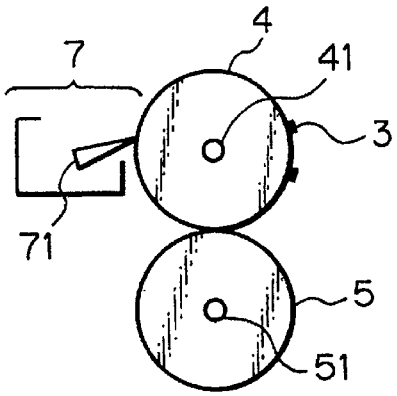
FIG. 2 is a side elevation of a section for removing a film-like image forming substance and also included in the device of the present invention.
Figure 3:
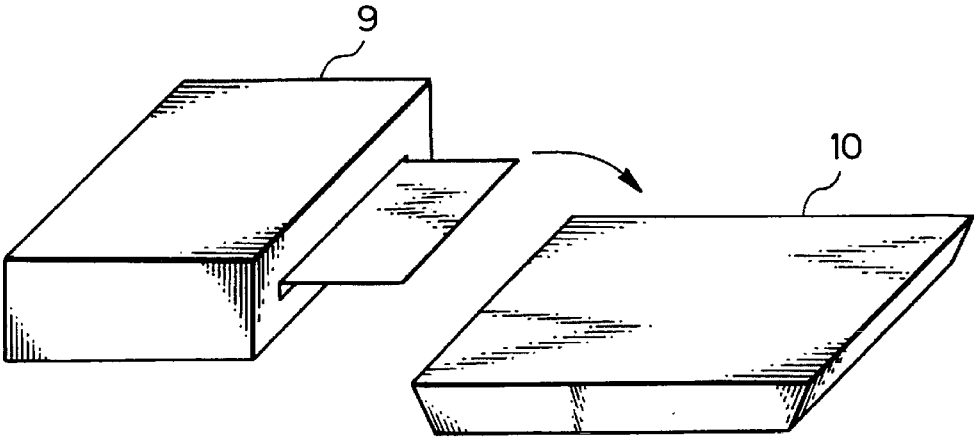
FIG. 3 is a perspective view of a drying unit also included in the device of the present invention.

As shown in FIGS. 1 and 2, a separate roller, or separating means, 4 is covered with a separating member which exerts an adhering force between it and the substance 3 which is greater than the adhering force acting between the substance 3 and the medium 2. A heater 41 is disposed in the separate roller 4 to play the role of softening means. A heat roller, or pressing means, 5 has thereinside a heater 51 playing the role of auxiliary softening means. The medium 2 is passed through between the separate roller 4 and the heat roller 5. As a result, the substance 3 is transferred from the medium 2 to the separating member of the separate roller 4.

Preferably, the separating member of the separate roller 4 should withstand heat and pressure during the course of movement of the medium 2, maintains its surface stable against the accelerator 1, and in addition desirably separates the substance 3. Specifically, the separating member may be implemented by synthetic or natural rubber, polyester, diarylate resin, xylene resin, alkylbenzene resin, epoxy resin, epoxyarylate resin, silicone resin, urethane resin, fluorine resin, vinyl chloride resin, polypropyrene, polystyrene, polyamide, methacryl resin, polyacetal, polycarbonate, cellulose-based resin, polyvinyl alcohol, polyimide, polyamide imide, polyethylene terephthalate or similar synthetic resin, aluminum-, copper-, nickel-, iron- or similar metal-based material, or an alloy or oxide thereof. If desired, titanium or similar metal or titanium oxide or similar metal oxide may be dispersed in the synthetic resin.

The separate roller 4 may be replaced with a separate belt. In this case, the above-stated resin should preferably be provided in at least two layers, i.e., a substrate and a surface layer on the separate belt, and each layer should preferably be formed of a suitable material. This will prevent the belt from stretching due to tension and heat and will provide it with durability.

For the substrate or support member, use may be made of a rubber roller or sheet or a tape, e.g., cellophane tape, craft paper adhesive tape, polyvinyl chloride tape, aceton tape or filament reinforcing tape.

The heaters 41 and 51 disposed in the rollers 4 and 5, respectively, closely contact the opposite sides of the medium 2 and heat the substance 3 adhered to the medium 2. As a result, the substance 3 is softened and caused to come off easily. This should preferably be done at a temperature higher than the softening point of the substance 3, but such that the substance 3 does not melt at the position where the medium 2 contacts of the roller 4. Should the substance 3 melt, it would be difficult to transfer it from the medium 2 to the roller 4 without splitting it into two parts, one adjoining the medium 2 and the other adjoining the roller 4. On the other hand, when the medium 2 is heated to an excessive degree, it is likely that the medium 2 is excessively dried while moving in contact with the roller 4. As a result, the adhesion of the substance 3 to the medium 2 is intensified, compared to the case where the medium 2 is wet. This is apt to cause the medium 2 to adhere to the roller 4 via the substance 3. Therefore, the medium 2 should preferably be heated to such a degree that it, passed through the heating section, is still slightly wet and prevents the substance 3 from adhering to it again. Cleaning means 7, which will be described, removes the substance 3, paper dust, smears and other impurities transferred from the medium 2 to the separating member of the roller 4. After the separation of the substance 3, the medium 2 is dried by a drying unit 9 and then driven out to a tray unit 10.

The cleaning means 7 may clean the roller 4 every time the roller 4 separates the substance 3, or every time it operates a predetermined number of times, or at predetermined intervals, as desired. A cleaning member 71, included in the cleaning means 7, should preferably be capable of exerting a shearing force on the impurities deposited on the separating member, and capable of scraping them off. Specifically, the cleaning member 71 may be implemented as a blade or a roller-like brush having a base greater in length than the width of the medium 2, and bristles implanted in the base. An experimental estimation showed that a brush made of metal, hard plastic, hard rubber or similar material, and a blade made of the same material have a desirable cleaning ability, as will be described in relation to a first to a fifth embodiment later. Such cleaning members may be used along or in combination, as desired.

It was found that the cleaning member 71 can remove the impurities from the separating member more easily when the surface temperature of the separating member is selected to be lower than the surface temperature assigned to the separation of the substance 3. This is presumably because the adhesion of the substance 3 to the separating member is weaker at low temperature than at high temperature, or because the modulus of elasticity increases with a decrease in the temperature of the substance 3 and enhances the shearing force exerted by the cleaning member 71.

Figure 8:
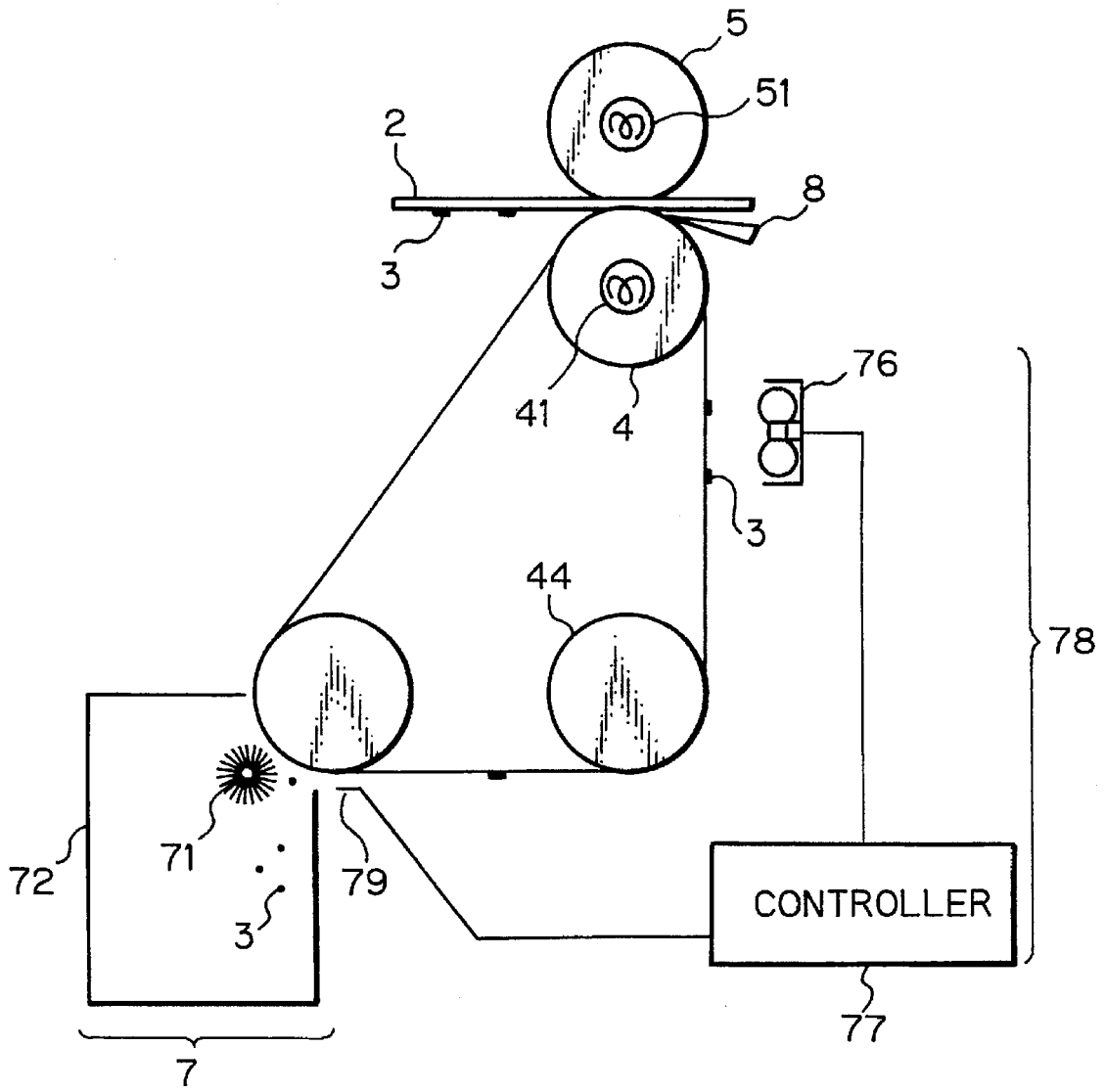
FIG. 8 is a section showing a third embodiment of the present invention.

To make the surface temperature of the separating member lower at the time of cleaning than at the time of separation, a distance, both in time and space, great enough for the surface of the separating member to be naturally cooled off may be provided between the separating means and the cleaning means. However, it is more preferable to locate cooling means 78 (see FIG. 8) between the separating means and the cleaning means in order to positively cool the separating means. As shown in FIG. 8, the cooling means 78 may be made up of a blower 76 and control means 77 for controlling it. The blower 76 blows air of temperature lower than the surface temperature of the separating member against the separating member. If desired, a liquid may be sprayed onto the separating means in place of air. It is preferable to reduce the power consumption of the cooling means 78 and to maintain the surface temperature of the separating member substantially constant. For this purpose, means 79 for sensing the surface temperature at the time of cleaning and implemented by, for example, a thermistor may be used. Then, when the surface temperature rises above a predetermined value as determined by the sensing means 79, the cooling means 78 will be activated.

Further, there may be provided means for sensing the surface temperature of the separating means at the time of separation, and means for comparing the two surface temperature sensed at the different positions, and for controlling the cooling means 78 such that the temperature is lower at the time of cleaning than at the time of separation. With these means, it is possible to control the surface temperature at the time of separation and/or the surface temperature at the time of cleaning.

Figure 5:
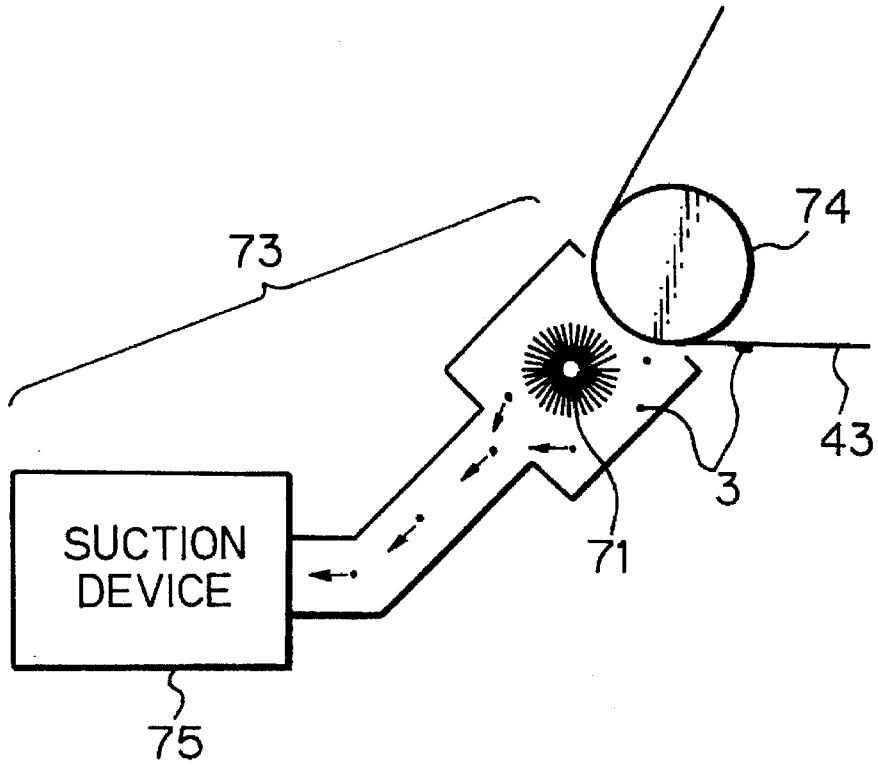
FIG. 5 is a section of means for preventing impurities removed from a separating member, included in cleaning means of the device of the present invention, from depositing on the separating member again.
Figure 6:
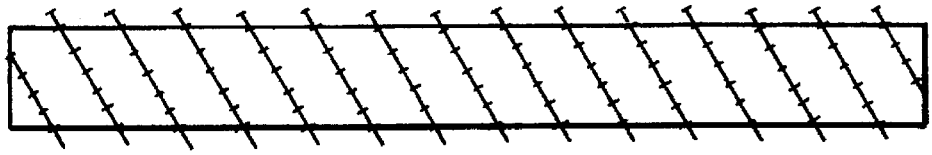
FIG. 6 shows a specific form of a cleaning member having bristles implanted in a spiral configuration.

Means 73 (see FIG. 5) may advantageously be used to prevent the impurities once removed from the separating member from depositing on the same member again. Specifically, as shown in FIG. 5, the means 73 includes a suction device 75 for sucking the impurities, removed from the separating member and floating in the air, away from the separating member. Alternatively, when the cleaning member is implemented as a brush, bristles may be implanted in a spiral or mesh configuration to allow the impurities to escape (see FIG. 6). The brush may be provided with a hollow support or rod in order to suck the impurities into the support; in which case, the impurities will be collected in a box via one end of the support.

Preferred embodiments of the device in accordance with the present invention will be described hereinafter.

1st Embodiment

Figure 4:
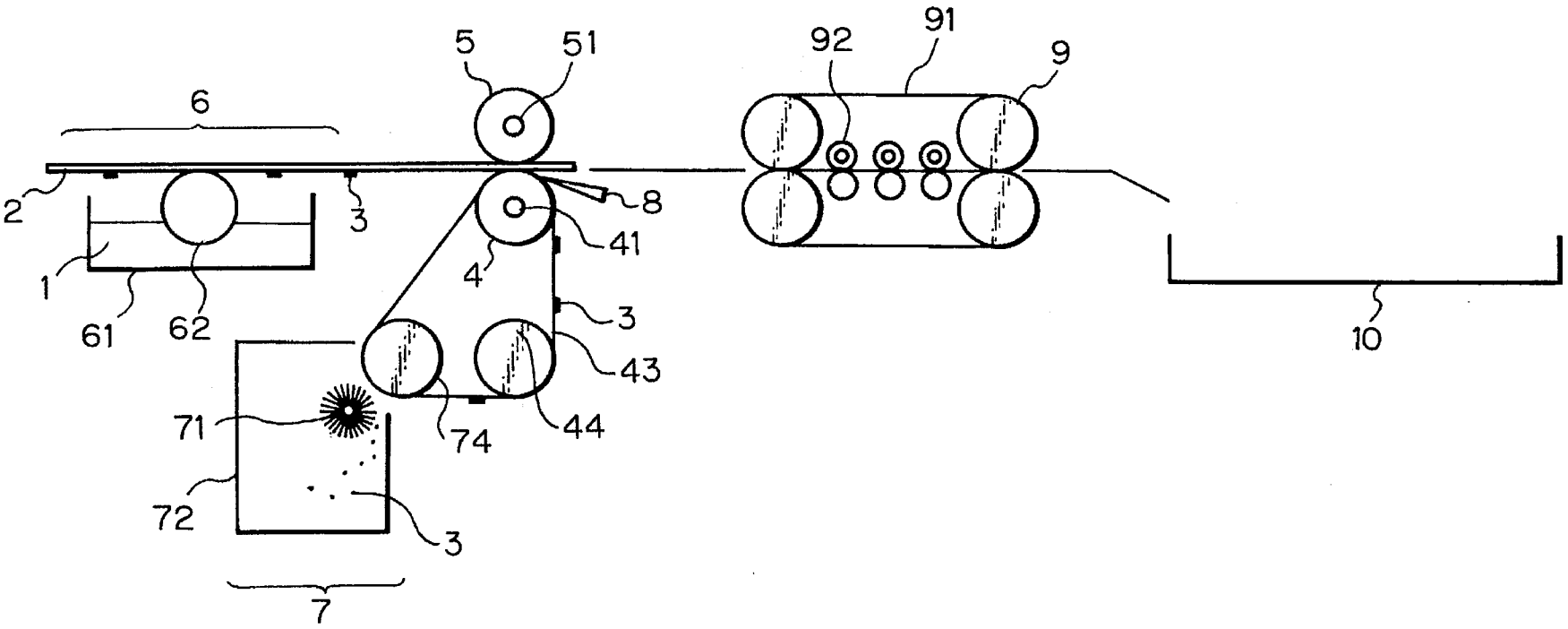
FIG. 4 is a section of a first embodiment of the device in accordance with the present invention.

As shown in FIG. 4, an accelerator supply section 6 for supplying the accelerator 1 to the medium 2 is located at the upstream side with respect to the intended direction of medium conveyance. It is to be noted that the words "upstream" and "downstream" to appear hereinafter are used in this sense without exception. The section 6 is made up of a container 61 storing the accelerator 1, and applying means implemented as a roller 62. The roller 62 is rotatably disposed in the container 61. In the illustrative embodiment, the accelerator 1 is an aqueous solution containing about 1 wt % of surfactant. The roller 62 may be formed of sponge which is liquid-absorptive. A separate belt 43 and the heat roller 5 are positioned downstream of the section 6. The belt 43 and roller 5 are so rotated as to drive the medium 2 coming out of the roller 62 further downward.

In the embodiment, the surface of the belt 43 is covered with a separating member made of polyethylene terephthalate (PET) in which the previously mentioned titanium oxide is dispersed. The cleaning means 7 removes the impurities from the belt 43. The cleaning means 7 has the brush 71 rotatable in contact with the belt 43 for removing the impurities from the belt 43, and a box 72 for collecting the removed impurities. The cleaning means is spaced apart from the separating position by a distance great enough for the surface of the belt 43 to be naturally cooled off to a temperature lower than the temperature assigned to the separation.

A pawl 8 is located downstream of the belt 43 and roller 5 in order to separate the medium 2 from the belt 43. The drying unit 9 is positioned downstream of the pawl 8 in order to remove excess water from the medium 2 and thereby render it reusable. The drying unit 9 has a belt 91 for conveying the medium 2, and dry rollers 92 for heating the medium 2 while supporting the belt 91. The tray unit 10 is located downstream of the drying unit 9 and receives the regenerated medium 2.

The device shown in FIG. 4 was operated to repeat a procedure for removing the substance 3 from the medium 2 fed into the device. First, the procedure was executed without the brush 71, i.e., without cleaning the separating member. Then, a residual image appeared on the medium 2 when the procedure was repeated ten times. When the procedure was repeated ten times with a rotary brush made of brass, no residual images appeared on the medium 2.

2nd Embodiment

Figure 7:
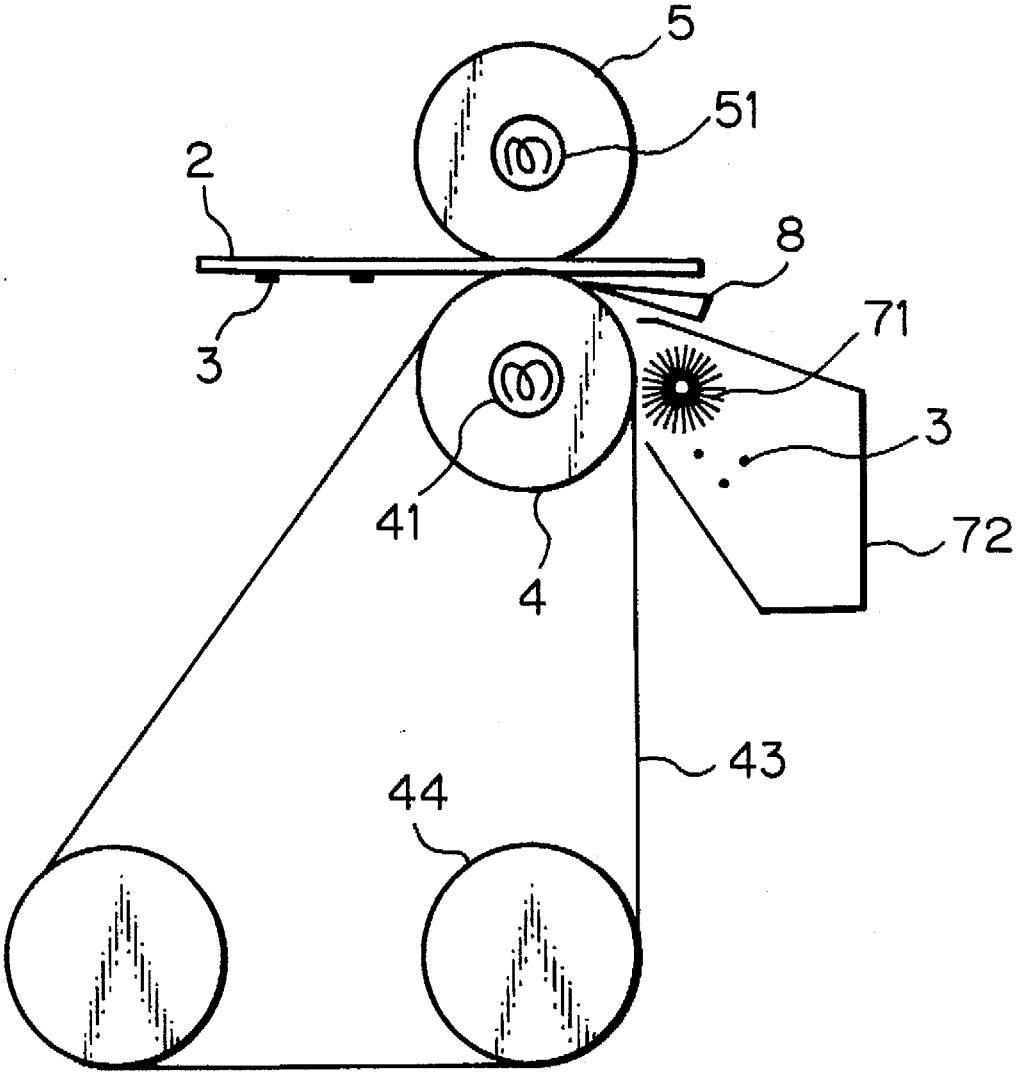
FIG. 7 is a section showing a second embodiment of the present invention.

As shown in FIG. 7, the cleaning means of the first embodiment is located immediately after the separating means. At this cleaning position, the surface temperature of the separating means was measured to be substantially equal to the temperature at the separating position. In this connection, in the first embodiment and the arrangement of FIG. 2, the surface temperature at the cleaning position was lower than the surface temperature at the separating position and was close to room temperature.

It was found that when the separating member was cleaned at a position where cleaning means has customarily been located, substantially no impurities were left on the cleaning member at the position downstream of the cleaning means. However, when the separating member was cleaned at the position of FIG. 5, i.e., immediately after the separating means, the impurities were left on the separating member in a great amount. This indicates that more desirable cleaning is achievable when the surface temperature of the separating member is lower at the time of cleaning than at the time of separation.

3rd Embodiment

As shown in FIG. 8, the blower 76 is positioned between the separating section and the cleaning section included in the first embodiment. The regenerating procedure was executed while causing the blower 76 to blow air against the separating member. After the procedure had been repeated 100 times, the surface temperature of the separating member was found to be substantially the same as at the initial stage. This is contrastive to the case where the blower 76 is absent.

4th Embodiment

In the first embodiment, cleaning members implemented by materials and configurations listed in Table 1 below were prepared, and each was mounted to the device in order to estimate the cleaning ability.

TABLE 1

| Material | Configuration | Cleaning Ability |
|---|---|---|
| stainless steel | rotary brush | ○ |
| brass | rotary brush | ◎ |
| nylon (hard) | rotary brush | ○ |
| nylon (soft) | rotary brush | X |
| stainless steel | blade | ○ |
| nylon (hard) | blade | ○ |
| thick paper | blade | Δ |
| hard rubber | blade | ○ |
| stainless steel | rotary brush (spiral) | ◎ |
| brass | rotary brush (spiral) | ◎ |
| brass | rotary brush (mesh) | ◎ |

In Table 1, the words "spiral" and "mesh" each refers to the configuration of bristles. It will be seen that brush members formed of metal and hard plastic, and blades made of metal, hard plastic and hard rubber exhibit a desirable cleaning characteristic.

5th Embodiment

As shown in FIG 5, the suction device 75 was added to the arrangement of the first embodiment. The device 75 encloses the cleaning member in order to suck the impurities removed frown the separating member. The device 75 is implemented by a commercially available vacuum cleaner, but having a modified sucking section. When the fifth embodiment was estimated in the same manner as the first embodiment, the former reduced the impurities on the separating member more than the latter.

In summary, it will be seen that the present invention provides a device for removing a film-like image forming substance from a recording medium and having the following advantages.

(1) The device includes cleaning means for cleaning a separating member and cleans it desirably. Hence, the separating member disposed in the device can maintain a surface condition optimal for separation, thereby ensuring stable repeated separation.

(2) The surface temperature of the separating member is selected to be lower at the time of cleaning than at the time of separation. This further promotes the separation of the substance and the cleaning of the separating member.

(3) Means is provided for preventing impurities once removed from the separating member from depositing on it again. Hence, the impurities are prevented from depositing on the separating member again during the course of the subsequent separating steps.

Various modifications will become possible for those skilled in the art after receiving the teachings of the present disclosure without departing from the scope thereof.

What is claimed is:

1. A device for removing a film-like image forming substance from a recording medium, comprising:

supplying means for supplying to the medium a water-containing removal accelerating liquid which causes a swelling layer of said medium to swell more than the substance provided on said medium;

separating means for pressing, after said liquid has been supplied to the medium, a separating member against said medium with or without heating to thereby transfer the substance from said medium to said separating member and thereby regenerate said medium;

cleaning means for removing impurities deposited on said separating member; and setting means for causing a surface temperature of said separating member to be lower at the time of cleaning than at the time of separation.

2. A device as claimed in claim 1, wherein said setting means comprises cooling means positioned between said separating means and said cleaning means, and for lowering the surface temperature of said separating member.

3. A device as claimed in claim 2, wherein said cooling means comprises fluid ejecting means for ejecting a fluid of temperature lower than the surface temperature of said separating member against said separating member.

4. A device as claimed in claim 2, further comprising sensing means for sensing the surface temperature of said separating member at the time of cleaning, wherein said cooling means is activated when said sensing means senses a surface temperature higher than a predetermined value.

5. A device as claimed in claim 1, wherein said cleaning means comprises fluid ejecting means for ejecting a gas or a liquid under pressure against said separating member to thereby remove the impurities.

6. A device as claimed in claim 1, wherein said cleaning means removes the impurities by exerting a shearing force on said impurities.

7. A device as claimed in claim 6, wherein said cleaning means is movable relative to said separating means.

8. A device as claimed in claim 7, wherein said cleaning means comprises a roller-like brush member having an elongate base longer than a width of the medium, and bristles implanted in a periphery of said base.

9. A device as claimed in claim 8, wherein said bristles are implanted in said base in a spiral or mesh configuration.

10. A device as claimed in claim 1 further comprising preventing means for preventing the impurities removed from said separating member from depositing on said separating member again.

11. A device as claimed in claim 10, wherein said preventing means sucks the impurities removed from said separating member.

* * * * *